US005563365A

United States Patent [19]

Dineen et al.

[11] Patent Number: 5,563,365

[45] Date of Patent: Oct. 8, 1996

[54] CASE BASE/COMBUSTIBLE CARTRIDGE CASE JOINT

[75] Inventors: John J. Dineen, Wharton; Andrea L. Zivari-Giannoglou, Montclair, both of N.J.

[73] Assignee: The United States of America as represented by the Secretary of the Army, Washington, D.C.

[21] Appl. No.: 373,991

[22] Filed: Dec. 21, 1994

Related U.S. Application Data

[63] Continuation of Ser. No. 105,981, Aug. 9, 1993, abandoned.

[51] Int. Cl.[6] ..... F42B 5/18

[52] U.S. Cl. ..... 102/431; 102/430; 102/467; 102/469; 102/700

[58] Field of Search ..... 102/430–433, 102/464, 465, 466, 467, 469, 470, 700

[56] References Cited

U.S. PATENT DOCUMENTS

| | | | |
|---|---|---|---|
| 3,955,506 | 5/1976 | Luther et al. | 102/467 |
| 4,159,678 | 7/1979 | Luther et al. | 102/469 |
| 5,048,421 | 9/1991 | Swartout | 102/431 |
| 5,155,295 | 10/1992 | Campoli | 102/430 |
| 5,444,208 | 8/1995 | Mortensen | 102/700 |

FOREIGN PATENT DOCUMENTS

| | | | |
|---|---|---|---|
| 919583 | 3/1947 | France | 102/466 |
| 2705235 | 8/1978 | Germany | 102/430 |
| 3332676 | 3/1985 | Germany | 102/439 |
| 2044416 | 10/1980 | United Kingdom | 102/466 |

*Primary Examiner*—Harold J. Tudor
*Attorney, Agent, or Firm*—Saul Elbaum; Edward Goldberg; Michael C. Sachs

[57] ABSTRACT

A new joint for use in combustible cartridge case munitions which reduces the risk of combustible cartridge case and case base and seal assembly separation during routine handling and minimizes the problems related to dechambering, comprised of a seal mated to the case base and into the exterior of the combustible cartridge case.

2 Claims, 7 Drawing Sheets

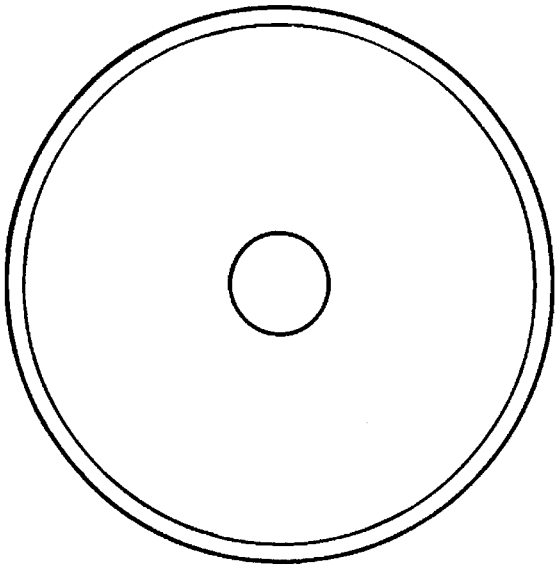
FIG. 2A (PRIOR ART)
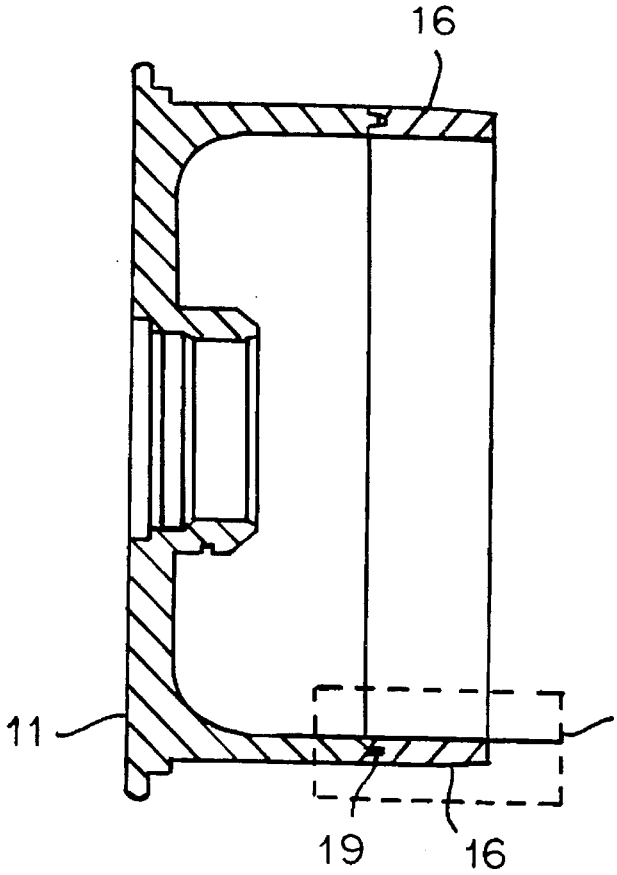
FIG. 3A
FIG. 3 (PRIOR ART)

CASE BASE/COMBUSTIBLE CARTRIDGE CASE JOINT

The invention described herein may be manufactured, used and licensed by or for the Government for Governmental purposes without payment to me of any royalties therein.

This application is a continuation of Ser. No. 08/105,981, filed on Aug. 9, 1993, now abandoned.

BACKGROUND OF THE INVENTION

I. Field of Invention

This invention relates to the problems related to the handling of combustible case cartridges and the chambering and dechambering of such cartridges wherein the case base partially separates or completely separates from the combustible cartridge case, creating a hazard.

II. Background of the Invention

Surveillance reports of the 120 mm tank ammunition have shown that the case base and seal assembly (FIG. 3) partially separates or completely separates from the combustible cartridge casing 10 during routine handling. This separation is due to the deformation of the spring disc 12 which holds the combustible cartridge casing 10 in place at the case's 10 dome area 13.

In addition, when the obturator 14 of the cartridge 10 is swollen, a cartridge 10 chambered with enough force could cause the cartridge 10 to deform away from the case base and seal assembly (FIG. 3) and stick in the gun tube. This would make dechambering even more difficult.

Any dechambering difficulty is exaggerated because pulling on the case base 11 is required to extract the entire cartridge (FIG. 1), which could cause the case base and seal assembly (FIG. 3) to separate from the combustible cartridge case 10 and a propellant 22 spill could then occur.

This invention provides a new method of attaching case base and seal assembly (FIG. 3) to the combustible cartridge case.

SUMMARY OF INVENTION

It is an object of this invention to provide a new joint between the case base and seal assembly and the combustible cartridge case which eliminates the problems of case base to combustible cartridge case separation.

It is still a further object of this invention to provide a case base and seal assembly to the combustible cartridge case joint which is reasonable to manufacture using a mold for the rubber seal in lieu of any machining of the case base.

It is a further object of this invention to enable the case base and seal assembly and combustible cartridge case to interface only at the joint area, allowing the removal of the dome area, thus decreasing the likelihood of burning residue from the combustible cartridge case.

BRIEF DESCRIPTION OF THE DRAWINGS

FIG. 2A is a rear view of the dome area of the combustible cartridge case.

FIG. 3 is a cross sectional view of the case base identifying the detail area of the seal to be found at FIG. 3A.

DETAILED DESCRIPTION OF THE PREFERRED EMBODIMENT

Figure 1:
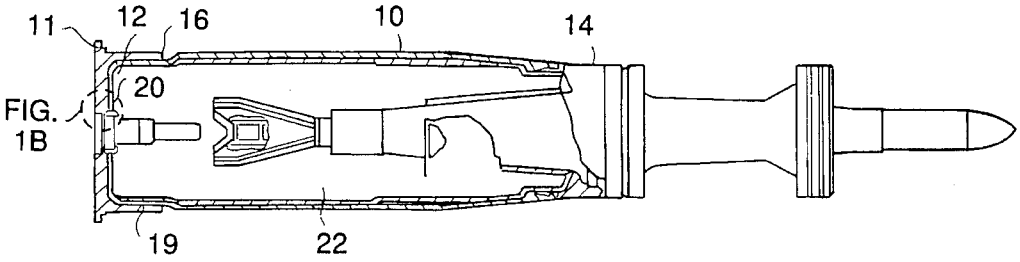
FIG. 1 (PRIOR ART)
FIG. 1 is a schematic of typical 120 mm tank ammunition.
Figure 1A:
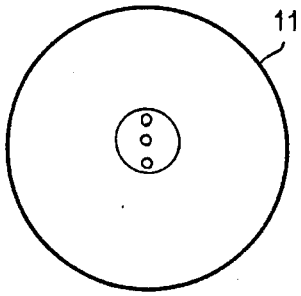
FIG. 1A (PRIOR ART)
FIG. 1A is a rear view of the existing case base and seal assembly.
Figure 2:
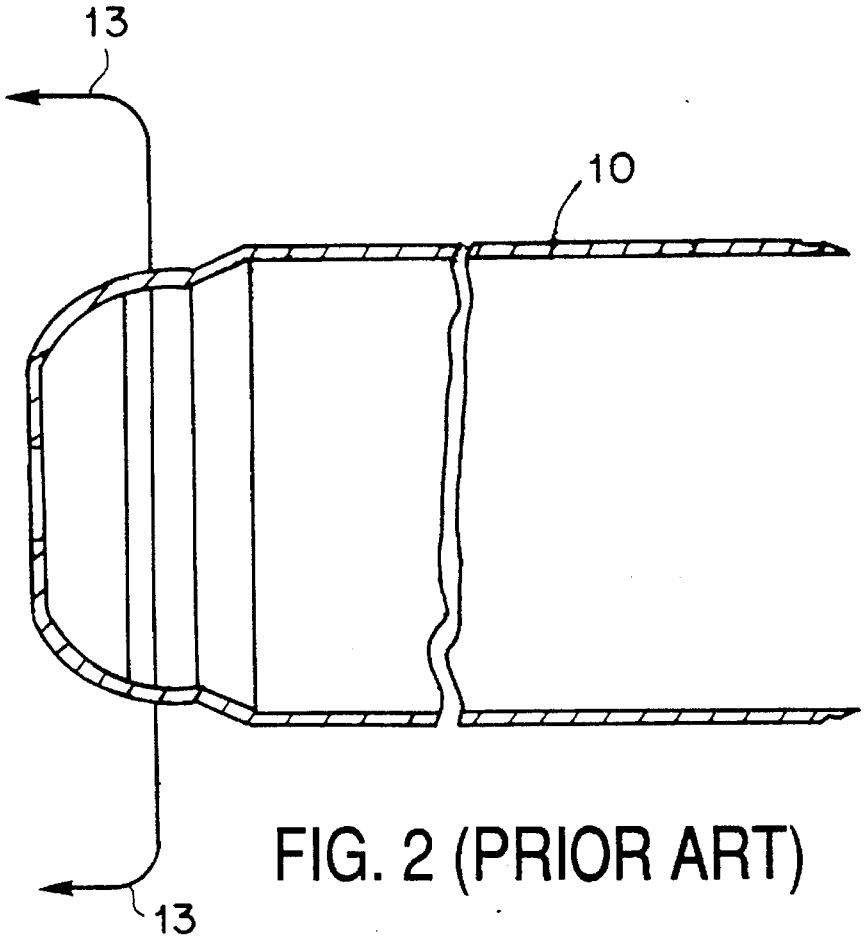
FIG. 2 (PRIOR ART)
FIG. 2 is a schematic which defines the dome area of the existing combustible cartridge case.
Figure 3A:
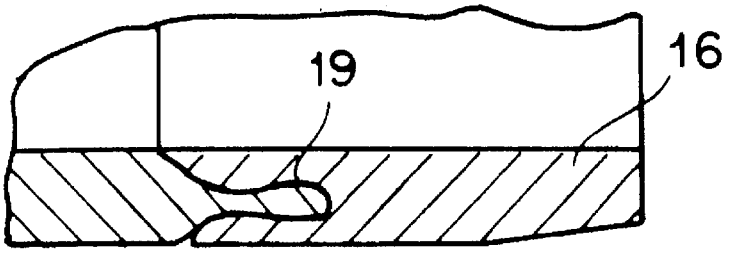
FIG. 3A (PRIOR ART)
FIG. 3A is the detail area A of the seal found attached to the case base.
Figure 3B:
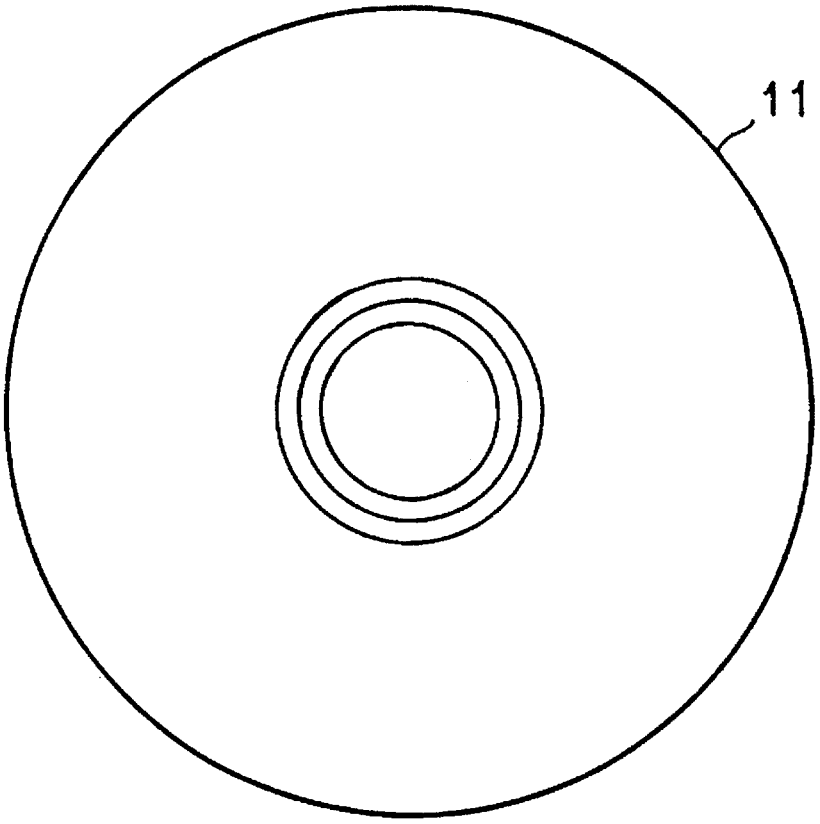
FIG. 3B (PRIOR ART)
FIG. 3B is a view of the rear of the case base.
Figure 4:
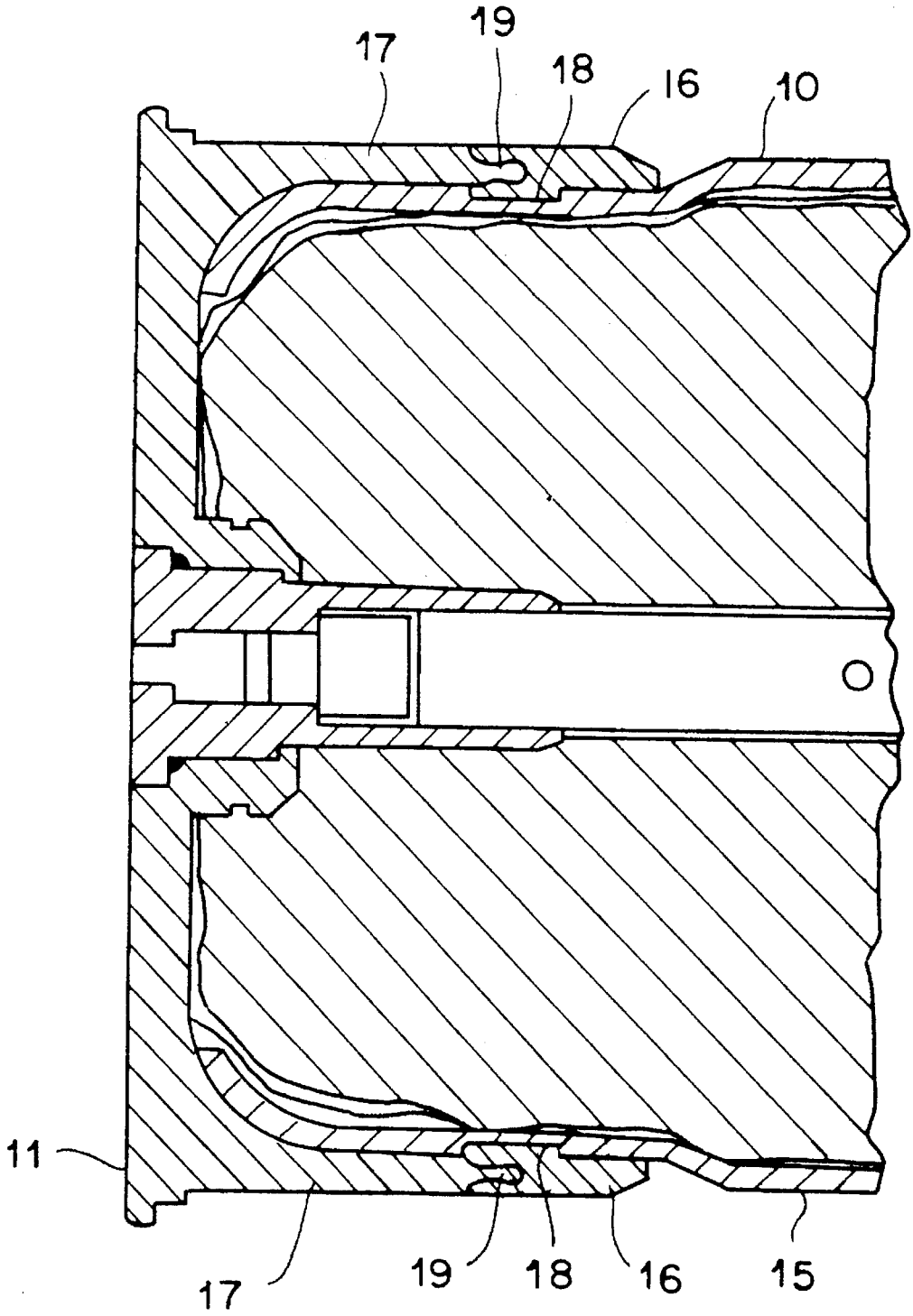
FIG. 4 is a cross sectional view of a case base and seal assembly mated to the exterior of the combustible cartridge case. The seal is one monolithic piece which acts as the male portion of the joint. It is fitted into the female portion of the combustible cartridge case. The combustible cartridge case is snapped into the case base and seal assembly.

FIG. 1 is a schematic of a typical 120 mm tank round of ammunition. FIGS. 2 and 3 depict the various elements of the prior art which are involved in the separation and dechambering problem. In particular, the current joint between the case base and seal assembly (FIG. 3) with the combustible cartridge case 10 are shown in FIG. 1. FIG. 3A shows the tear drop male connector 19 mated to the current seal 16. FIG. 4 shows the new case base and seal assembly (FIG. 3) to the combustible cartridge case 10 joint developed. The detent 18 is part of the rubber seal of the case base and seal assembly 16 and is used to secure the side wall 15 of the combustible cartridge case 10.

Figure 5:
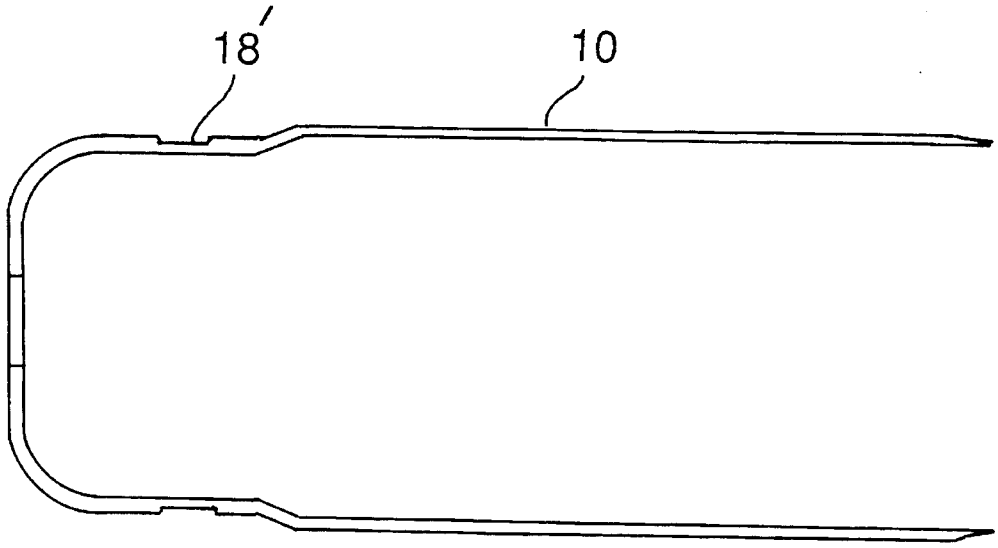
FIG. 5 depicts the changed combustible cartridge case which is used as the female portion of the joint.

FIG. 4 further depicts the final design wherein it is found to be rigid enough because the rubber detent 18 is between the metal "tear drop" 19 of the case base 11 and combustible cartridge case 10. Only a new mold is required to mold the rubber seal 16, rather than any machining of the case base 11. FIG. 5 depicts that the mating combustible cartridge case 10 only requires machining of the groove "18" as part of its regular production. Assembly of the joint as shown as FIG. 6 requires only the pressing of the combustible cartridge case 10 into the case base 11 as shown at FIG. 4.

FIG. 5 depicts the grooved area "18" machined into the combustible cartridge case 10 at the time of manufacture of the said combustible cartridge case 10 which allows the rubber seal with its detent 16 to fit into the very surface of the combustible cartridge case 10.

Figure 6:
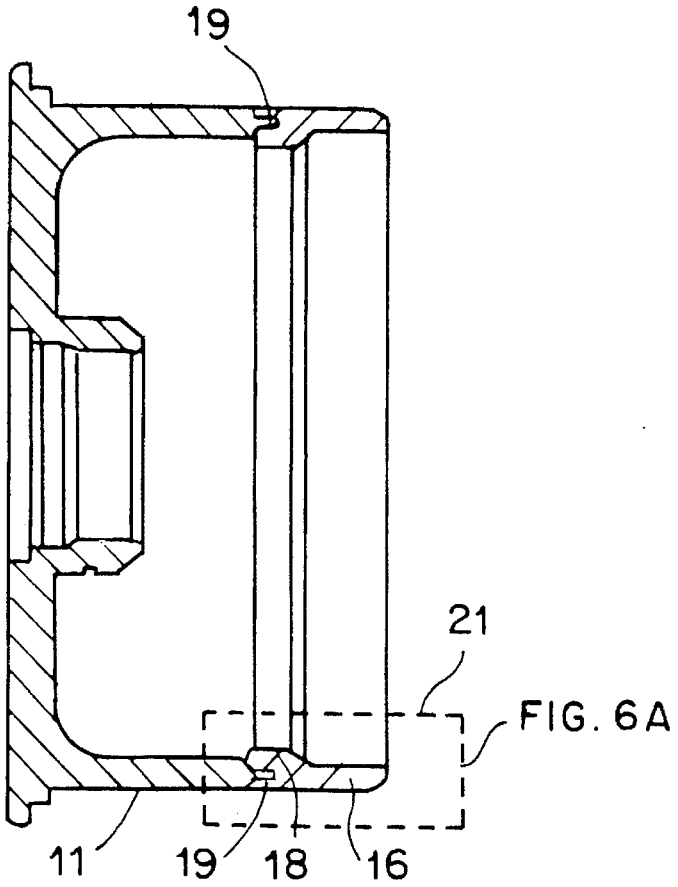
FIG. 6 depicts the case base and seal assembly used as the male portion of the joint.
Figure 6A:
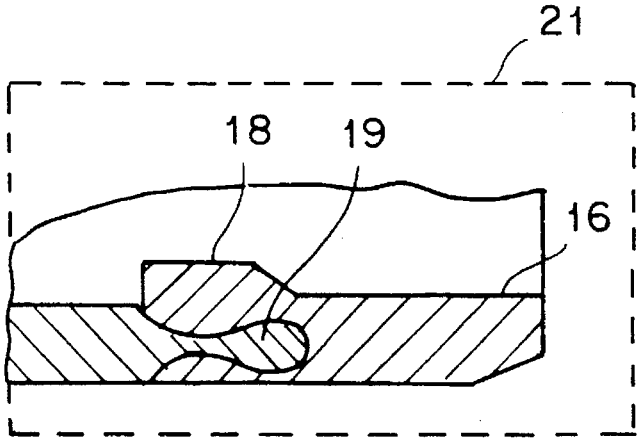
FIG. 6A is the detail of the silicone rubber seal.

FIG. 6 and FIG. 6A show the design which enables the case base and seal assembly (FIG. 3) and combustible cartridge case 10 to interface only at the Joint area 21 described at FIG. 6A. This makes removing the dome area 13 shown at FIG. 2 of the combustible cartridge case 16 feasible, thus decreasing the likelihood of burning residue from the combustible cartridge case 10 when fired.

Burning residue is a great risk of 120 mm tank ammunition because if burning residue exists in the gun while another cartridge 10 is chambered, the cartridge 10 could ignite.

Figure 1B:
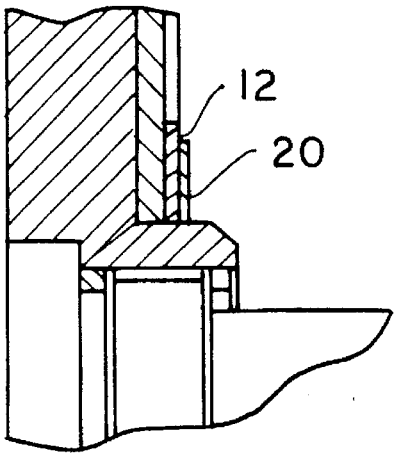
FIG. 1B (PRIOR ART)
FIG. 1B is a detail of the current joint with the use of a retaining ring and spring disc whose location is identified in FIG. 1.

Furthermore, the retaining ring 20 and spring clip as shown at FIG. 1 and FIG. 1B would no longer be needed, thus eliminating the cost of those components and their associated assembly procedure.

The new joint 21 at FIGS. 6, 6A has proven to be 40% stronger than the old design shown in FIG. 3A in pull tests. Furthermore, the new joint 21 has also passed an array of drop tests. Lastly, the new joint 21 shows that there is no pulling away of the case base 11 from the combustible cartridge case 10, as there is in the current design at FIGS. 1, 2, 3.

In the preferred embodiment, the changed combustible cartridge case 10 at FIG. 5 is pressed into the base case and seal assembly (FIG. 6) at FIG. 6 to yield the new case base to combustible cartridge case joint 21 as shown in FIGS. 4 and 6.

Thus, it is apparent that in accordance with the present invention, a functional design that fully resolves a serious military munitions problem is set forth above. While the invention has been described in conjunction with a specific embodiment, it is evident that many alternatives, modifications and variations will be apparent to those skilled in the light of the foregoing descriptions. Accordingly, it is intended that the present invention embrace all such alternatives, modifications, and variations as fall within the written spirit and broad scope of the appended claims.

What is claimed is:

1. A joint between an inside of a case base and rubber seal ring, and an exterior of a combustible case, which prevents separation during routine handling, eases dechambering and increases safety, comprising:

a tear drop projection on a front end of the case base which fits into said rubber seal ring, said rubber seal ring having an annular detent on an inner surface, said annular detent located radially inward from said tear drop projection on said case base, and said combustible case having an annular groove located within a rearward exterior surface of the combustible case, said annular groove mating with said annular detent.

2. The joint as in claim 1 wherein said rubber seal ring is formed of a silicone rubber.

* * * * *